US005997420A

United States Patent [19]

Chien

[11] Patent Number: 5,997,420

[45] Date of Patent: Dec. 7, 1999

[54] NET DEVICE FOR BALL GAMES HAVING A SHOCK ABSORBING MECHANISM

[76] Inventor: Michael Chien, No.1-1,Lane 156,Section 2,Chang Ping Road, Peitun Chu,Taichung City, Taiwan

[21] Appl. No.: 09/109,620

[22] Filed: Jul. 2, 1998

Related U.S. Application Data

[63] Continuation-in-part of application No. 08/865,730, May 30, 1997, abandoned.

[51] Int. Cl.[6] ..... A63B 61/00

[52] U.S. Cl. ..... 473/494

[58] Field of Search ..... 473/476, 478, 473/490, 494; 273/396, 400

[56] References Cited

U.S. PATENT DOCUMENTS 5,664,784 9/1997 Redlich et al. ..... 273/396

*Primary Examiner*—William H. Grieb

*Attorney, Agent, or Firm*—Charles E. Baxley, Esq.

[57] ABSTRACT

A net device for a ball game and for securing on a frame includies a woven outer member disposed in the peripheral portion for securing to the frame of the ball game. A resilient member is secured to the peripheral portion or engaged in the woven outer member of the net for increasing the resilience of the net and for allowing the net to be easily attached to the frame of the goal of the ball game. The resilient peripheral portion of the net may be used for absorbing the vibrations and shocks that may be transmitted to the net for preventing the net from being easily damaged by balls and players.

1 Claim, 4 Drawing Sheets

NET DEVICE FOR BALL GAMES HAVING A SHOCK ABSORBING MECHANISM

The present invention is a continuation-in-part of U.S. patent application Ser. No. 08/865,730, filed on May 30, 1997, now abandoned.

BACKGROUND OF THE INVENTION

1. Field of the Invention

The present invention relates to a net, and more particularly to a net device for ball games having a shock absorbing mechanism for absorbing shocks and vibrations that may be transmitted to the net.

2. Description of the Prior Art

Typical nets for ball games are solidly secured to the goal and have no shock absorbing mechanism for absorbing shocks such that the nets will be easily damaged by the balls and the players.

In order to solve the problem, U.S. Pat. No. 5,664,784 to Redlich et al. discloses a rebound net system for sports balls which includes a reinforced periphery. However, the reinforced peiphery is directly engaged onto the peripheral portion of the structure and may also be easily damaged and worn down.

The present invention has arisen to mitigate and/or obviate the afore-described disadvantages of the conventional nets.

SUMMARY OF THE INVENTION

The primary objective of the present invention is to provide a net for ball games in which the net includes a shock absorbing mechanism for absorbing vibrations and shocks that may be transmitted to the net and for increasing the working life of the net.

In accordance with one aspect of the invention, there is provided a net for a ball game and for securing on a frame, the net comprises a net body including a woven outer member provided in the peripheral portion, and a resilient member secured to the peripheral portion or engaged in the woven outer member of the net body for increasing a resilience of the net body and for allowing the net body to be easily attached to the frame. The resilient peripheral portion of the net may be used for absorbing the vibrations and shocks that may be transmitted to the net for preventing the net from being easily damaged by balls and players.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
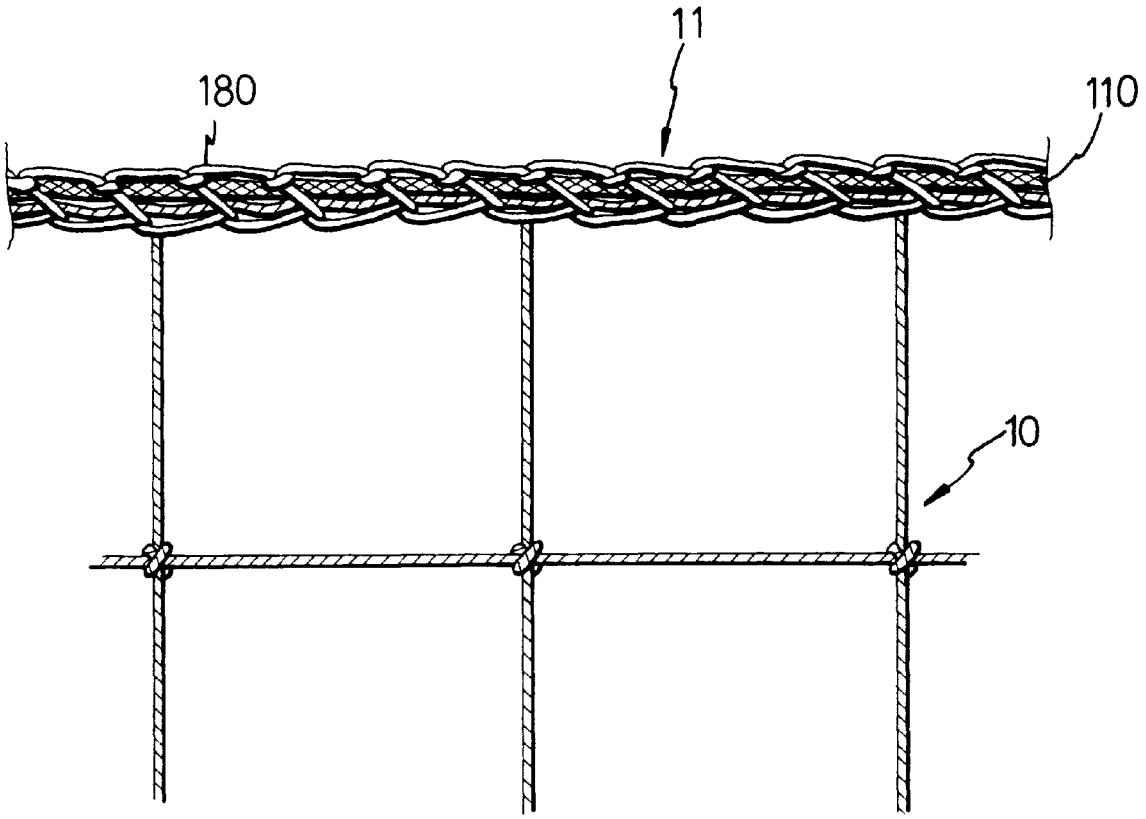
FIG. 1 is a partial plane view of a net device in accordance with the present invention.
Figure 4:
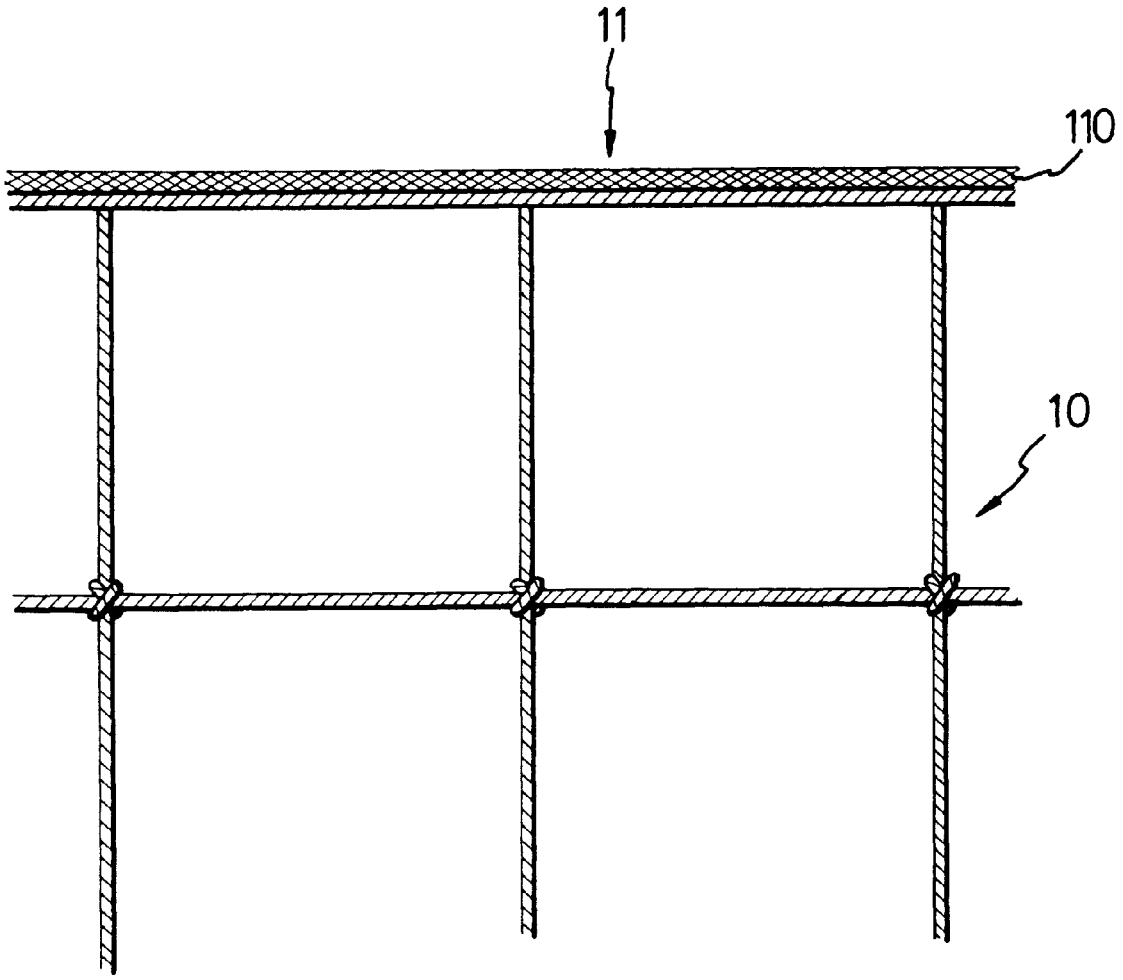
FIG. 4 is a partial plane view illustrating another application of the net device in accordance with the present invention.

Referring to the drawings, and initially to FIG. 1. a net in accordance with the present invention is provided for ball games and comprises a net body 10 including a peripheral portion 11 having a resilient belt 110 engaged in the peripheral portion 11 for increasing the resilience of the peripheral portion of the net body 10. The net body 10 includes a woven outer member 180 provided in the peripheral portion thereof. The resilient belt 110 may be engaged in the woven outer member 118 that is provided in the peripheral portion 11 of the net body 10 (FIG. 1) or may be secured to the outer peripheral portion 11 of the net body 10 as shown in FIG. 4.

Figure 2:
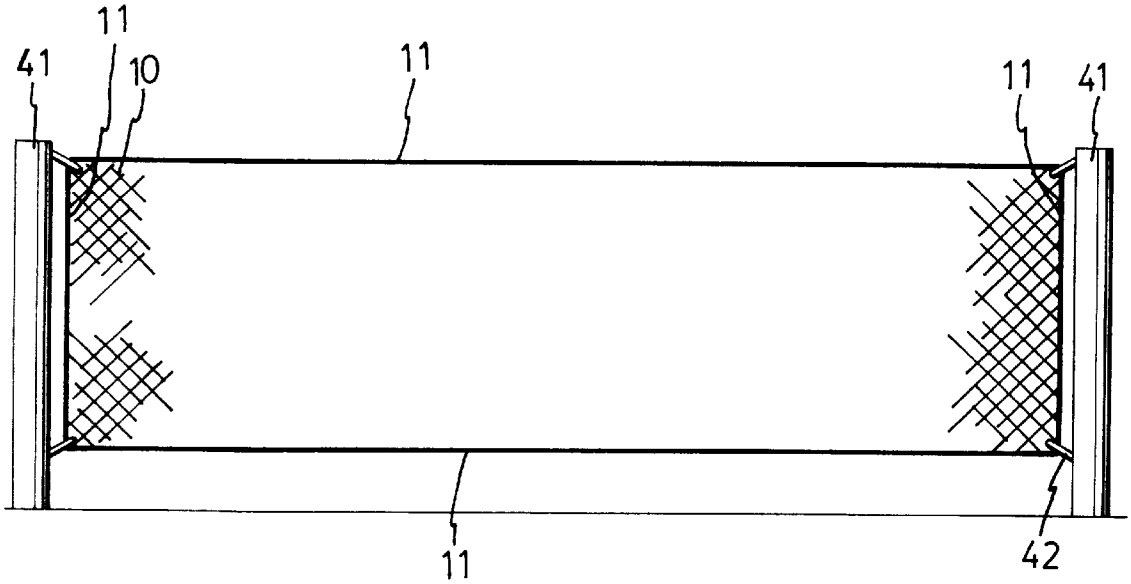
FIG. 2 is a plane view illustrating the operation of the net device.
Figure 3:
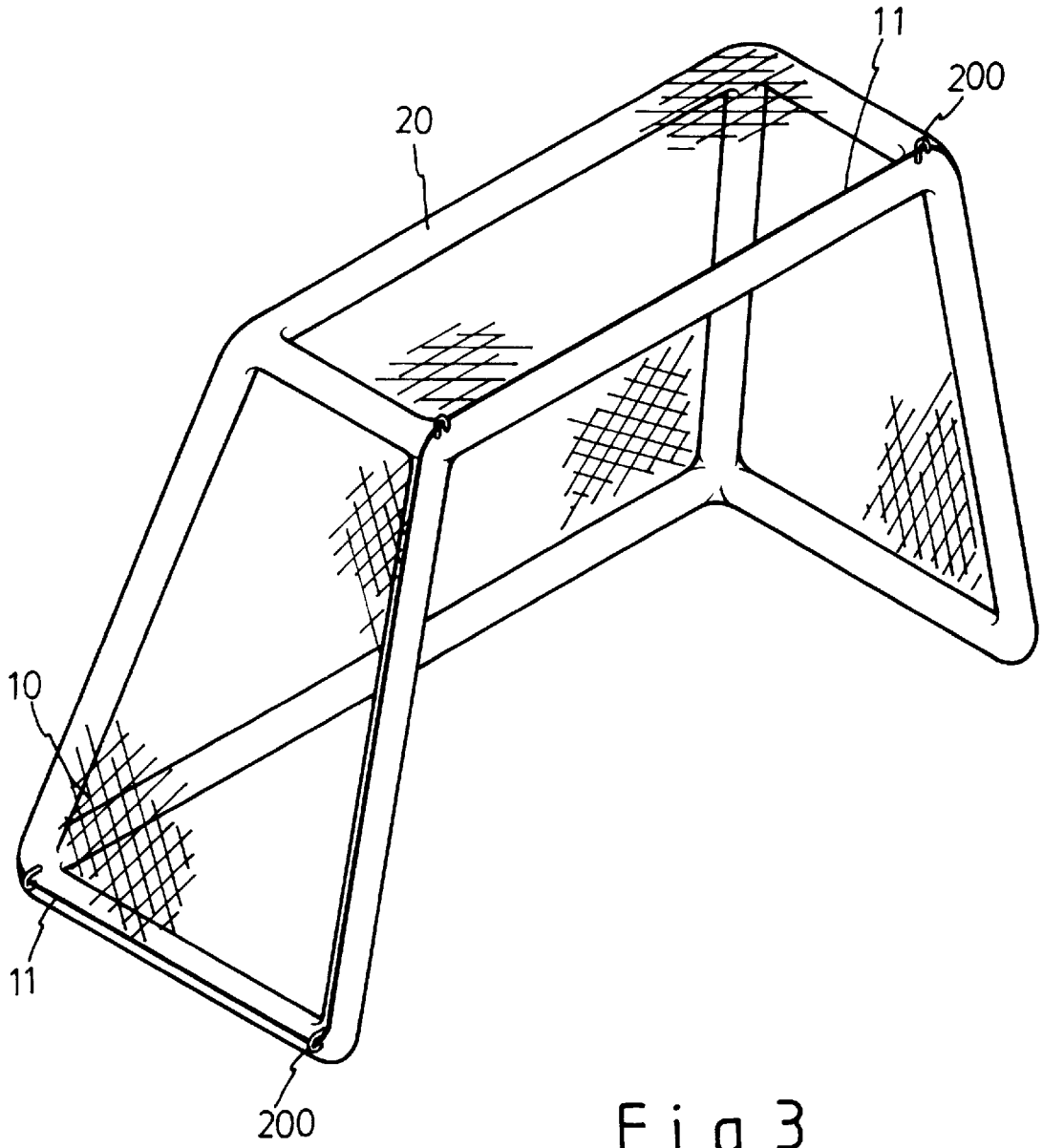
FIG. 3 is a perspective view illustrating the operation of the net device.

In operation, as shown in FIG. 2, the peripheral portion 11 of the net body 10 may be resiliently secured to the frame 41 formed by two posts 41 for forming the net for tennis games or for volleyball games. It is to be noted that the resilient belt 110 of the net body 10 may be easily and resiliently secured to the hook members 42 of the frame 41 without tightening the peripheral portion to the frame 41 which is required to be done for typical net. As shown in FIG. 3, the peripheral portion 11 of the net body 10 may also be easily secured to the engaging members 200 of the goal frame 20 which may be provided for foot ball game, hand ball game, hockey games, ice hockey games, etc.

It is to be noted that the net is not only excellent for installing purposes, the net nay also be used for absorbing vibrations and shocks that may be transmitted to the net. For example, when a foot ball is shot on the net or when a player hit onto the net, the resilient outer peripheral portion 11 of the net may absorb the vibrations and shocks so as to prevent the peripheral portion 11 from being easily damaged. In addition, the resilient belt 110 is engaged in and suitably protected by the woven outer member 180 such that the resilient belt 110 is not required to be directly engaged onto the engaging members 200 and may be suitably protected by the woven outer member 180 and such that the working life of the net device may be suitably increased.

Accordingly, the net device in accordance with the present invention includes a shock absorbing mechanism for absorbing vibrations and shocks that may be transmitted to the net and for increasing the working life of the net.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A net device for a ball game and for securing on a frame, said net comprising:

a net body including a peripheral portion and including a woven outer member provided in said peripheral portion of said net body, and a resilient member engaged in said woven outer member for increasing a resilience of said net body and for allowing said net body to be easily attached to the frame.

* * * * *